United States Patent [19]

Lee

[11] Patent Number: 4,742,912

[45] Date of Patent: May 10, 1988

[54] PACKAGE ASSEMBLY

[76] Inventor: Noel Lee, 47 W. Park Dr., Daly City, Calif. 94015

[21] Appl. No.: 42,435

[22] Filed: Apr. 24, 1987

[51] Int. Cl.[4] ..... B65D 21/00

[52] U.S. Cl. ..... 206/459; 206/461; 206/504

[58] Field of Search ..... 206/504, 508, 509, 461, 206/471, 464, 459, 470

[56] References Cited

U.S. PATENT DOCUMENTS 3,056,525 10/1962 Deinert ..... 206/508 X
3,111,220 11/1963 Bostrom ..... 206/470 X
3,412,888 11/1968 Andrews et al. ..... 206/508 X
3,985,289 10/1976 Prince ..... 206/464 X
4,453,629 6/1984 Goldberg ..... 206/504 X

*Primary Examiner*—William Price
*Attorney, Agent, or Firm*—Warren B. Kice

[57] ABSTRACT

A package assembly in which two plate members define two planer surfaces disposed in an overlapping, engaging relationship. One of the plate members has a protruding portion which, together with the other plate member, defines an enclosure for the article to be packaged. A flange extends around the margins of the other plate member to define a cavity for receiving the protrusion of an adjacent plate member when the package assemblies are disposed in a stacked, or nested, relationship.

8 Claims, 2 Drawing Sheets

PACKAGE ASSEMBLY

BACKGROUND OF THE INVENTION

This invention relates to a package assembly and more particularly to a two-piece assembly for enclosing an article to be packaged in a manner so that the package and the article can be readily displayed and dispensed.

Various techniques have been used to package relatively small articles for storage on a rack, or the like, so that they may be easily displayed and dispensed. However, there are problems associated with several of these designs. For example, some packaging techniques, including blister packs, etc. utilize a plastic material extending over another material, with the article to be packaged disposed therebetween. However, the protruding portion of the package assembly which houses the article makes it difficult and unsightly to stack the packages in an orderly and neat manner.

SUMMARY OF THE INVENTION

It is, therefore, an object of the present invention to provide a package assembly which enables an article to be packaged in an attractive manner.

It is a further object of the present invention to provide a package assembly of the above type which permits a plurality of assemblies to be stacked in a neat and orderly manner.

It is a further object of the present invention to provide a package assembly of the above type in which a cardboard insert can be easily secured in the packaging assembly and positioned properly with respect to the article to be packaged.

Toward the fulfillment of these and other objects, the package assembly of the present invention comprises two plate members disposed in a juxtaposition relationship with flanges extending from one of the surfaces of one of the plate members to form a cavity. The other plate member defines a planer surface in engagement with a planer surface of the first plate member and includes a protruding portion, which together with the other planer surface, defines an enclosure for the article to be packaged. The size of the cavity is sufficient to receive the protruding portion of an adjacent assembly when a plurality of assemblies are stacked.

BRIEF DESCRIPTION OF THE DRAWINGS

The above brief description as well as further objects, features and advantages of the method of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
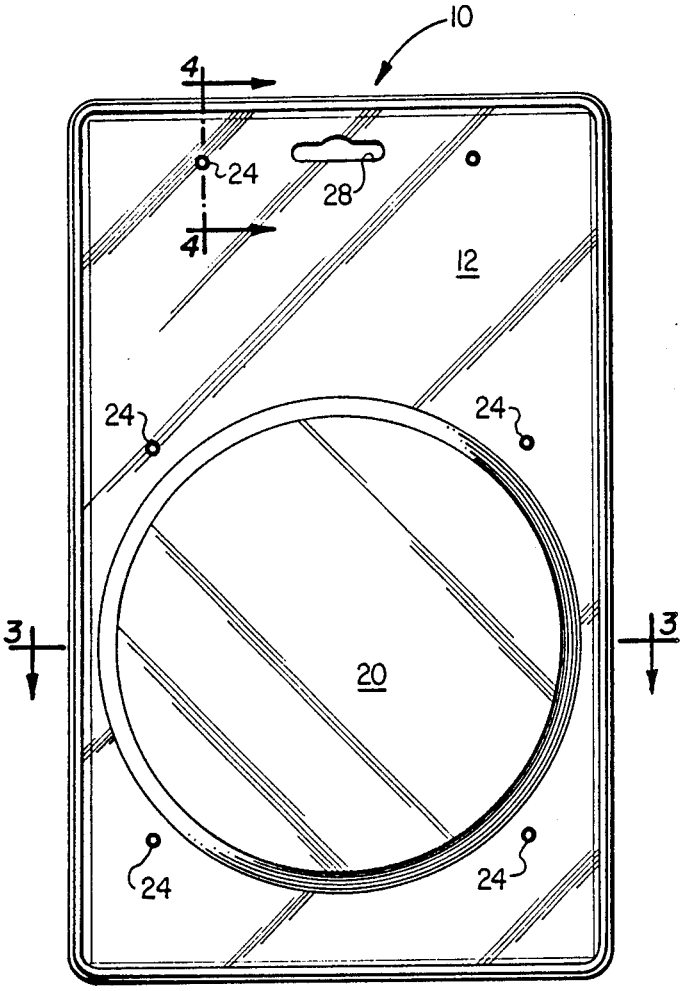
FIG. 1 is a front elevation of the package assembly of the present invention.
Figure 2:
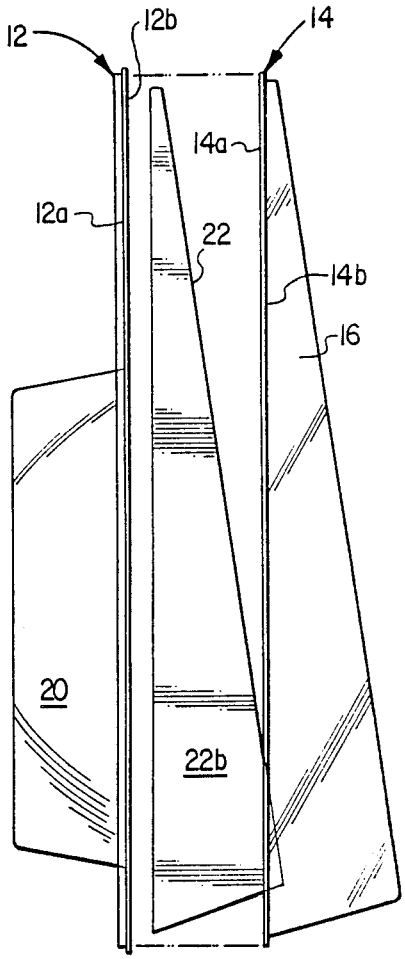
FIG. 2 is an exploded side elevation of the assembly of FIG. 1.
Figure 3:
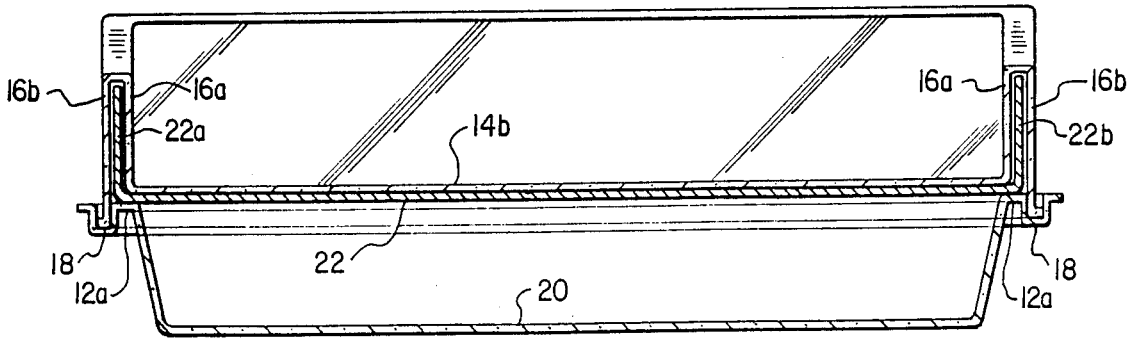
FIG. 3 is an end elevational view of the assembly of FIGS. 1 and 2.

Referring specifically to FIGS. 1–3 of the drawings, the reference numeral 10 refers in general to the package assembly of the present invention which comprises a first plate-like member 12 extending over or in juxtaposition with a second plate-like member 14 (FIG. 2).

Each of the plate members 12 and 14 are formed of a translucent plastic material. As shown in FIG. 2, the plate member 12 has two opposed planer surfaces **12*a* and 12*b*, and the plate member 14 has two opposed planer surfaces 14*a* and 14*b*. In the assembled condition of the assembly the planer surfaces 12*b* and 14*a*** engage in an overlapping relationship.

As better shown in FIG. 3, a flange 16 extends around the margins of the plate member 14 and projects from the planer surface **14*b*. The flange is U-shaped to form a recessed portion and includes a first leg portion 16*a* which is formed integrally with the edge of the plate member 14 and a leg portion 16*b* spaced slightly from the leg portion 16*a* and protuding slightly beyond the planer surface 14*a* of the plate member 14. The portions of the flange 16 extending along the side edges of the plate member 14 are tapered to form triangular cross sections as shown in FIG. 2** for reasons to be explained.

A U-shaped flange 18 is formed around the margins of the plate member 12 and receives the projecting portion of the leg **16*b* of the flange 16**.

The plate member 12 includes a protruding portion 20 which is formed integral therewith and has a circular configuration, which, together with the cooperating planer surface of **14*a* of the plate member 14**, defines an enclosure for the article to be packaged (not shown).

As shown in FIGS. 2 and 3, a cardboard insert 22 may be sandwiched between the plate members 12 and 14 and can be used to identify the product and describe same. As shown in FIG. 3, the side marginal portions **22*a* and 22*b* of the insert 22 are bent inwardly and extend in the U-shaped flange 16** and thus are tapered in the same manner as the latter flange.

Figure 4:
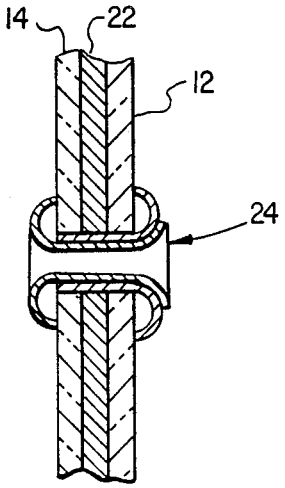
FIG. 4 is a cross-sectional view taken along the line 4—4 of FIG. 1.

In addition to the fastening afforded by the engagement of the projecting portion of the flange **16*b* with the flange 18 as shown in FIG. 3, a plurality of rivets 24 can be provided at various locations of the assembly as shown in FIG. 1. The details of a rivet 24 are shown in FIG. 4 and, as shown, each rivet extends through aligned openings formed in the plates 12 and 14 and the insert 22. Each rivet 24 can be fabricated of metal and fastened to the assembly in a conventional manner. Since the rivets 24** are conventional they will not be described in any further detail.

Figure 5:
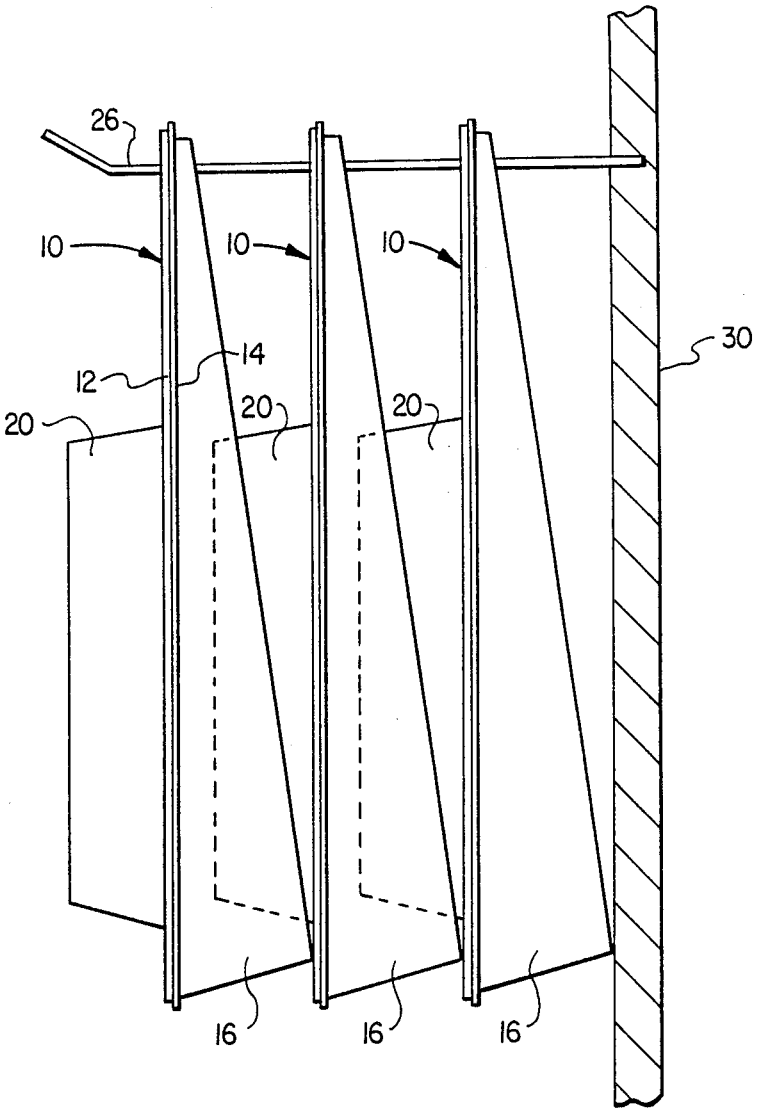
FIG. 5 is a side elevation of a plurality of package assemblies of FIGS. 1 and 2 shown in a stacked, or nested, relationship.

As shown in FIG. 5, a plurality of assemblies 10 are shown in their nested, or stacked, condition supported by a mounting rod 26 extending through openings 28 formed in the assemblies. The rod 26 is mounted on a support member 30 which forms a portion of a display counter or rack. As shown, the plates 12 and 14 of each assembly extend vertically due to gravity and the protruding portion 20 of each assembly extends within the cavity formed by the flanges 16 and the plate member 14, so as to make an attractive, orderly display taking up minimal space.

It is understood that several variations may be made in the foregoing without departing from the scope of the invention. For example, other means of fastening the plate members 12 and 14 together may be utilized and the materials described above can be varied.

Other modifications, changes, and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A package assembly comprising a first plate member defining two opposite planer surfaces, a U-shaped flange extending from the side edges of one of said planer surfaces to form a cavity, said flanges defining a recessed portion extending around said edges, a second plate member defining a planer surface in engagement with the other of said planer surfaces of said first plate member, said second plate member including a protruding portion which, together with said other planer surface of said first plate member, defines an enclosure for the article to be packaged, display means extending between said other planer surface of said first member and said planer surface of said second member, with the margins of said display means extending in said recessed portions of said flanges, the size of said cavity being sufficient to receive the protruding portion of an adjacent assembly when a plurality of assemblies are stacked, or nested, together, and means for securing said plate members together.

2. The assembly of claim 1 wherein said second plate member defines two opposite planer surfaces, one of which is in engagement with said other planer surface of said first plate member, said protruding portion protruding from the other surface of said second plate member.

3. The assembly of claim 1 wherein said margins of said display means are bent at right angles to the remaining portion of said display means.

4. The assembly of claim 1 further comprising a U-shaped flange extending from said second plate member and adapted to receive a protruding portion of the free-end portion of said U-shaped flange extending from said first plate member.

5. A package assembly comprising a first plate member defining two opposite planer surfaces, flange means extending along the opposed marginal edges of one of said planer surfaces and projecting outwardly from said one surface, a second plate member defining a planer surface in engagement with the other of said planer surfaces of said first plate member, said second plate member including a protruding portion which, together with said other planer surface of said first plate member defines an enclosure for the article to be packaged, the size of said flange means being sufficient to enable the assembly to stand upright yet receive the protruding portion of an adjacent assembly when a plurality of assemblies are stacked, or nested, together, and means for securing said plate members together.

6. The assembly of claim 5 wherein said flange means extend perpendicular to said one surface and are tapered along their lengths.

7. The assembly of claim 5 wherein said plate members are rectangular in shape and wherein said flange means extend along the longitudinal marginal edges of said one surface.

8. The assembly of claim 5 wherein said second plate member defines two opposite planer surfaces, one of which is in engagement with said other planer surface of said first plate member, said protruding portion protruding from the other surface of said second plate member.

* * * * *